US009958126B2

(12) United States Patent
Wang et al.

(10) Patent No.: US 9,958,126 B2
(45) Date of Patent: May 1, 2018

(54) LASER HEADLIGHT SYSTEM AND LASER HEADLIGHT OPTICAL MODULE THEREOF

(71) Applicant: NATIONAL CHUNG CHENG UNIVERSITY, Chiayi County (TW)

(72) Inventors: Hsiang-Chen Wang, Chiayi County (TW); Yuan-De Su, Chiayi County (TW); Yao-Ting Chiang, Chiayi County (TW)

(73) Assignee: National Chung Cheng University, Chiayi County (TW)

( * ) Notice: Subject to any disclaimer, the term of this patent is extended or adjusted under 35 U.S.C. 154(b) by 220 days.

(21) Appl. No.: 14/982,209

(22) Filed: Dec. 29, 2015

(65) Prior Publication Data

US 2017/0184269 A1 Jun. 29, 2017

(51) Int. Cl.

| | |
|---|---|
| ***F21S 41/365*** | (2018.01) |
| ***F21S 8/10*** | (2006.01) |
| *F21S 41/176* | (2018.01) |

(52) U.S. Cl.

CPC ..... *F21S 48/1757* (2013.01); *F21S 48/1145* (2013.01); *F21S 48/1225* (2013.01)

(58) Field of Classification Search

CPC ..... F21S 48/1757; F21S 48/1145; F21S 48/1225; F21S 48/137; F21S 48/1752

See application file for complete search history.

(56) References Cited

U.S. PATENT DOCUMENTS 5,707,133 A * 1/1998 Burton ..... B60Q 1/0686 116/281

2012/0294023 A1* 11/2012 Nakazato ..... F21S 48/1104 362/510

* cited by examiner

*Primary Examiner* — Andrew Coughlin

*Assistant Examiner* — Nathaniel Lee

(74) *Attorney, Agent, or Firm* — Rosenberg, Klein & Lee

(57) ABSTRACT

A laser headlight optical module is disclosed herein and comprises a laser light source, a convex lens, a substrate, a mirror set, supporting rods, and a driving member. The laser light source generates a laser light and the convex lens is located at a transmitting path of the laser light generated from the laser light source and configured to focus the laser light. Yellow fluorescent powders are coated on the substrate. The mirror set is located at a transmitting path of the laser light reflected from the substrate with the phosphor layer. The supporting rods are located behind the mirror set to support the mirror set. The driving member is located behind the mirror set and connected with the supporting rods. The driving member drives the supporting rods to change a light reflective surface of the mirror set to vary an optical field.

9 Claims, 11 Drawing Sheets

LASER HEADLIGHT SYSTEM AND LASER HEADLIGHT OPTICAL MODULE THEREOF

BACKGROUND OF THE INVENTION

1. Field of the Invention

The present invention relates to a laser headlight optical module and more particularly relates to a laser headlight optical module and a laser headlight system with the laser headlight optical module having a high beam mode and a low beam mode.

2. Description of Related Art

Since laser diode includes features such as high light flux, small size, low power consumption, etc., the laser diode implemented in multimedia projectors and vehicle illumination systems possesses high development potential. Since the laser diode has an advantage of small size, an optical design of a laser headlight can have many different possibilities. By the optical design, the laser headlight is not limited to one function only. In the future, those functions, such as daytime lights, turn signal lights, fog lights, etc. are integrated within a vehicle headlight module, so vehicles can have more room for applications in different fields.

However, the design of the laser headlight is very complicated. In the conventional headlight, each of the optical modules in the headlight has to include many laser light sources to have high beams and low beams switching functions. Alternatively, some of the headlights need to include some shutters or reflective plates to have high beams and low beams. Those vehicle headlights with high and low beams switching functions are complicated in design and require many additional components to have high and low beams switching functions.

Therefore, according to the drawbacks of the laser light and the conventional vehicle headlight, a need arises to develop a laser headlight with simple design and the optical module in the laser headlight doesn't need to include additional laser light sources or shutters. The headlight can include a high beam mode and a low beam mode at the same time and the headlight complies with law regulations.

SUMMARY OF THE INVENTION

An objective of the present invention is to provide a laser headlight optical module and a laser headlight system that can operate in a high beam mode and a low beam mode by the optical module.

The laser headlight optical module of the present invention includes:

a laser light source configured to generate a laser light;

a convex lens located at a transmitting path of the laser light generated from the laser light source and configured to focus the laser light;

a substrate having a phosphor layer disposed thereon, and the phosphor layer located at a transmitting path of the laser light focused by the convex lens and including yellow fluorescent powders;

a mirror set located at a transmitting path of the laser light reflected from the substrate with the phosphor layer;

a plurality of supporting rods located behind the mirror set and configured to support the mirror set;

a driving member located behind the mirror set and connected with the supporting rods, and the driving member configured to drive the supporting rods to vary a light reflective surface of the minor set and change an optical field of the laser headlight optical module.

Another objective of the present invention is to provide a headlight system with a laser headlight optical module, and the laser headlight system can operate in high beams and low beams to comply with law regulation.

The laser headlight system of the present invention includes six optical modules. The six optical modules are separated into three of the optical modules at a top portion and three of the optical modules at a bottom portion. Each of the optical modules comprises:

a laser light source configured to generate a laser light;

a convex lens located at a transmitting path of the laser light generated from the laser light source and configured to focus the laser light;

a substrate having a phosphor layer disposed thereon, and the phosphor layer located at a transmitting path of the laser light focused by the convex lens and including yellow fluorescent powders;

a mirror set located at a transmitting path of the laser light reflected from the substrate with the phosphor layer;

a plurality of supporting rods located behind the mirror set and configured to support the minor set;

a driving member located behind the minor set and connected with the supporting rods, and the driving member configured to drive the supporting rods to vary a light reflective surface of the minor set and change an optical field of the laser headlight system.

The laser headlight optical module in the present invention can combine the two reflective lenses together to be a mirror set when the headlight is operated in the high beam mode. When the headlight is operated in the low beam mode, the reflective lens at the top portion is moved behind the reflective lens at the bottom portion and only the reflective lens at the bottom portion can reflect the light to generate an optical field with low beams. In the vehicle headlight system, by the optical design, six optical modules are used and the vehicle headlight system can operate in the high beam mode and the low beam mode separately to meet the illumination standard of the high beams and the low beams stipulated in the law regulations.

DETAILED DESCRIPTION OF THE PREFERRED EMBODIMENT

These and other aspects of the embodiments herein will be better appreciated and understood when considered in conjunction with the following description and the accompanying drawings.

Figure 1:
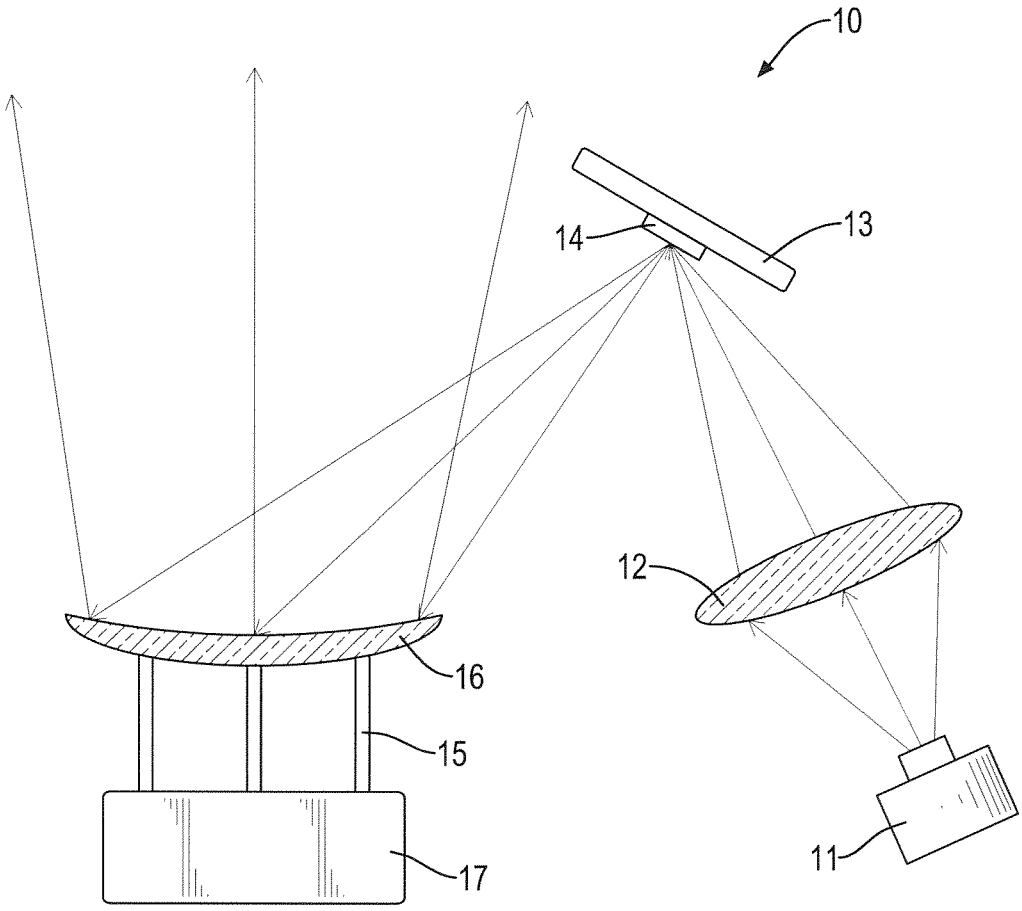
FIG. 1 is an optical path view of a laser headlight optical module of the present invention.

FIG. 1 is an optical path view of a laser headlight optical module of the present invention. As shown in FIG. 1, the laser headlight optical module 10 in the present invention includes a laser light source 11, a lens 12, a substrate 13, a phosphor layer 14, a plurality of supporting rods 15, a minor set 16, and a driving member 17. The laser headlight optical module 10 in the present invention may be installed in a headlight shell (not shown in figure) of a vehicle.

The laser light source 11 includes multiple laser diodes and configured to generate laser lights. The lens 12 is a convex lens. The lens 12 is located at a transmitting path of the laser lights generated by the laser light source 11 and configured to focus the laser lights. The phosphor layer 14 is coated on a surface of the substrate 13 and includes yellow fluorescent powders. The substrate 13 is located at the transmitting path of the laser lights focused by the lens 12. When the laser lights are focused by the lens 12 and emitted on the phosphor layer 14 of the substrate 13, the yellow fluorescent powder of the phosphor layer 14 will absorb blue light and reflect yellow light. The mirror set 16 is located at the transmitting path of the laser lights reflected from the phosphor layer 14 on the substrate 13. The supporting rods 15 are located behind the mirror set 16 and configured to support the minor set 16. The driving member 17 is located behind the minor set 16 and connected with the supporting rods 15. The driving member 17 may drive the supporting rods 15 to vary a light reflective surface of the minor set 16 and change an optical field of the laser headlight optical module 10.

Figure 2A:
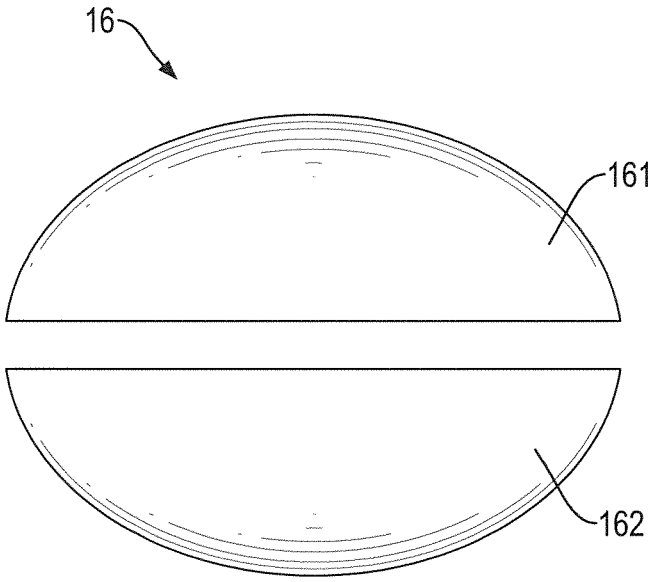
FIG. 2A and FIG. 2B are schematic plan views of a first reflective lens and a second reflective lens in the present invention.
Figure 2B:
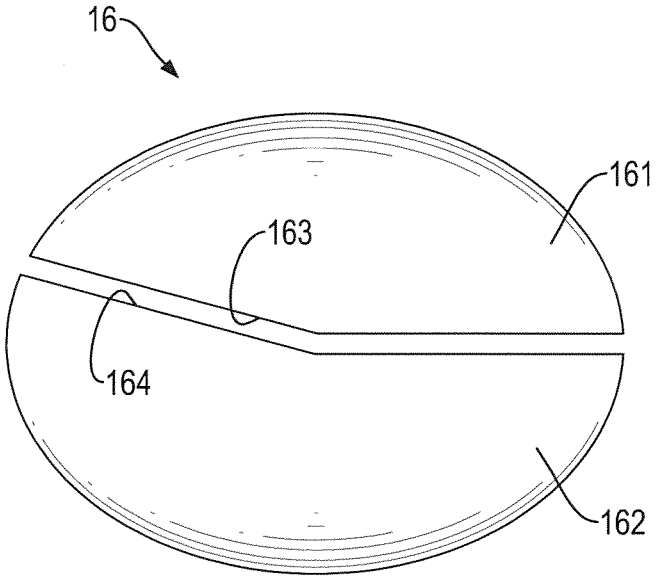

FIG. 2A and FIG. 2B are schematic plan views of the mirror set 16 in the present invention. As shown in FIG. 2A and FIG. 1, the minor set 16 of the laser headlight optical module 10 in the present invention includes a first reflective lens 161 and a second reflective lens 162. The first reflective lens 161 and the second reflective lens 162 are reflective lenses in a semi-elliptical shape. When the first reflective lens 161 is coupled with the second reflective lens 162, the mirror set 16 has an oval shape. In a different embodiment, as shown in FIG. 2B, the first reflective lens 161 and the second reflective lens 162 are reflective lenses with arc structures respectively. The first reflective lens 161 includes a first joint surface 163 and the second reflective lens 162 includes a second joint surface 164 able to connect with the first joint surface 163. The first joint surface 163 and the second joint surface 164 are complementary joints. For example, when an included angle of the first joint surface 163 is greater than or less than 180 degrees, an included angle of the second joint surface 164 is less than or greater than 180 degrees. Therefore, the first reflective lens 161 and the second reflective lens 162 can be coupled together to be the mirror set 16 in the oval shape.

With reference to FIG. 2A, FIG. 2B, and FIG. 1, when the laser headlight optical module 10 is operated in the high beam mode, the first reflective lens 161 and the second reflective lens 162 are coupled together to be the mirror set 16 in an oval shape. When the laser headlight optical module 10 is operated in a low beam mode, the first reflective lens 161 is moved by driving the supporting rods 15 via the driving member 17, and the first reflective lens 161 is moved behind the second reflective lens 162. Therefore, only the second reflective lens 162 in the laser headlight module 10 may reflect the laser lights and an optical field with low beams is generated. With regard to an illumination standard of a measurement point of the optical field with low beams in Economic Commission for Europe (ECE R112) vehicle regulation, also called Headlamps with an Asymmetrical Passing Beam vehicle regulation, an emitting direction of the second reflective lens 162 meets the illumination standard. In the usage of laser diodes, there are six laser diodes used as the laser light source in the present invention. Through the optical design, the headlight system can meet the illumination standard for high and low beams in ECE R112 regulation when the headlight system is operated in high and low beams. Therefore, the laser headlight optical module 10 with functions to switch between high and low beams is developed.

Figure 3A:
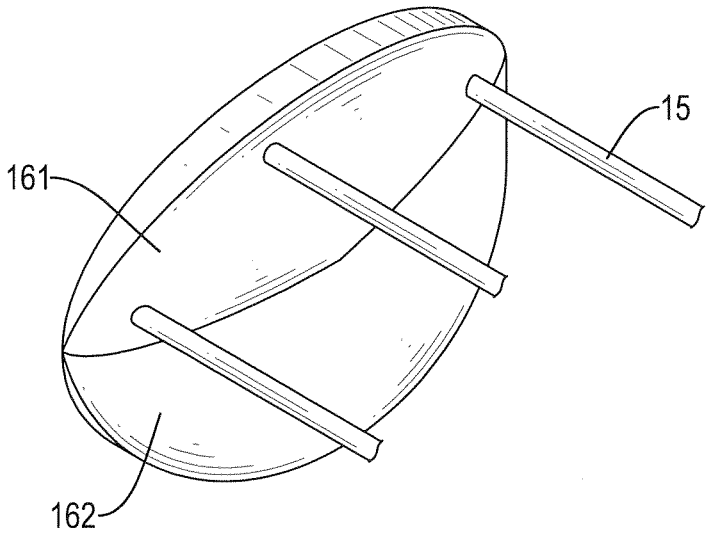
FIG. 3A-FIG. 3D are schematic motion views of the first reflective lens and the second reflective lens.
Figure 3B:
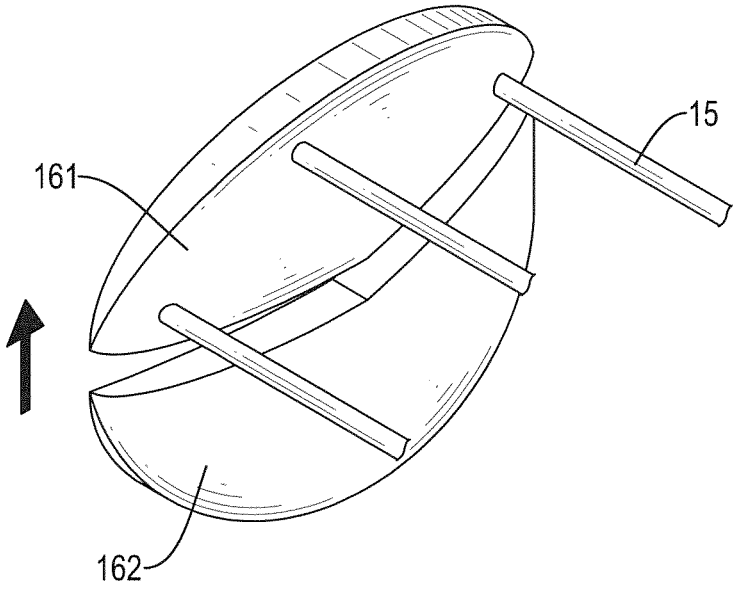
Figure 3C:
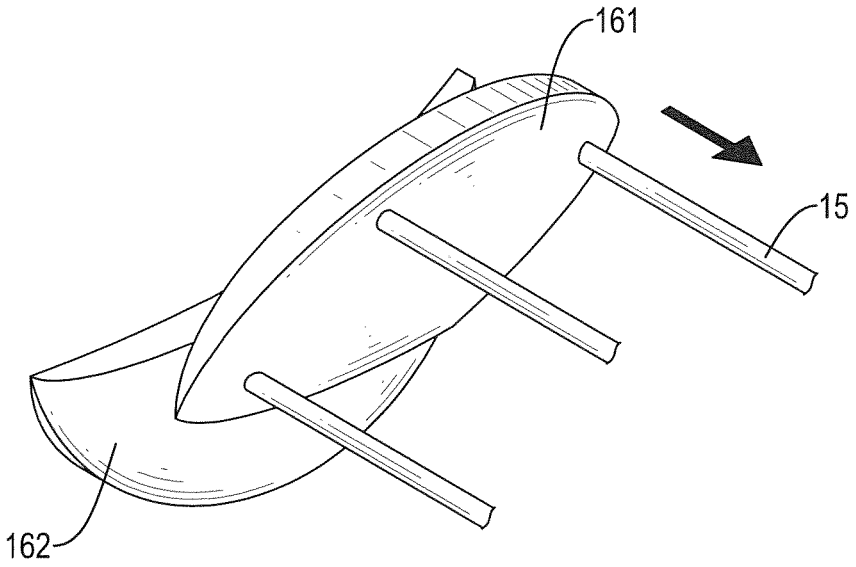
Figure 3D:
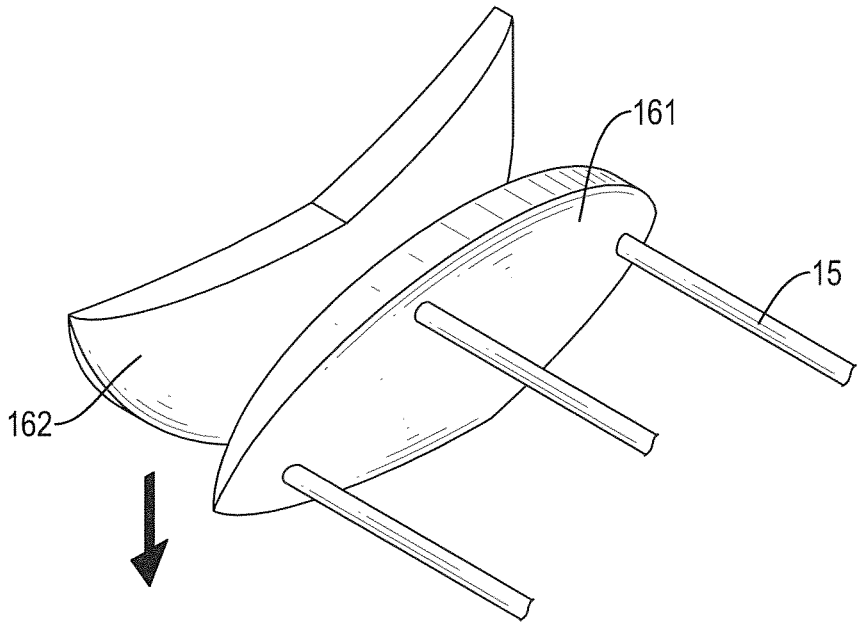

FIG. 3A-FIG. 3D are schematic motion views of the first reflective lens and the second reflective lens. As shown in FIG. 3A and FIG. 1, when the laser headlight optical module 10 in the present invention is operated in a high beam mode, the first reflective lens 161 and the second reflective lens 162 are closely coupled together to form an oval shape. When the laser headlight optical module 10 is operated in the low beam mode, as shown in FIG. 3B, the driving member 17 drives the supporting rods 15 to move the first reflective lens 161 upward along the longitudinal direction and the first reflective lens 161 is separated from the second reflective lens 162. Thereafter, as shown in FIG. 3C, the supporting rods 15 move the first reflective lens 161 backward along the horizontal direction and the first reflective lens 161 is moved behind the second reflective lens 162. In the low beam mode, since the first reflective lens 161 is moved behind the second reflective lens 162, only the second reflective lens 162 in the mirror set 16 can be used to reflect the laser lights emitted from the substrate 13. Therefore, the optical module in the present invention can meet the illumination standard of the low beams in the ECE R112 regulation.

Figure 4A:
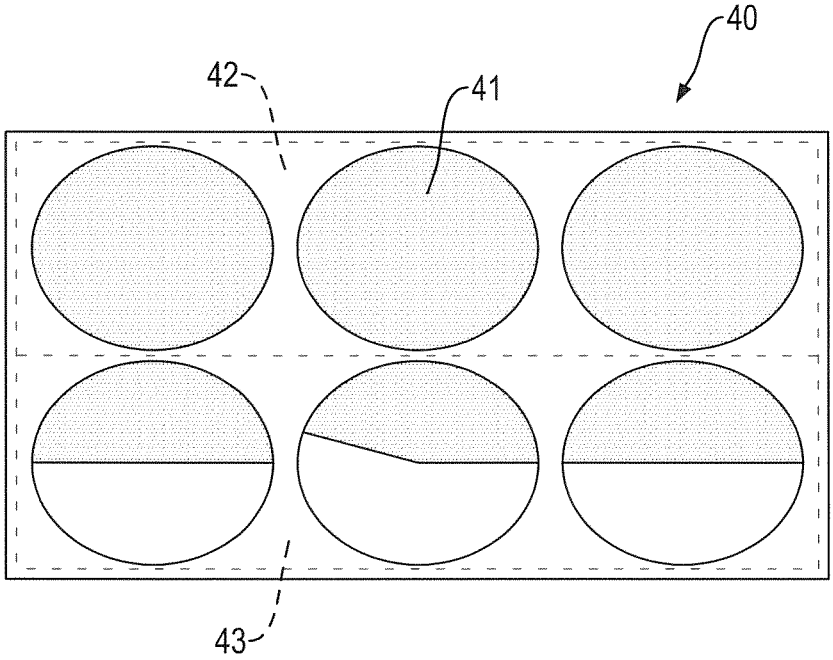
FIG. 4A and FIG. 4B are schematic working views of a laser headlight system capable of varying optical fields in the present invention.
Figure 4B:
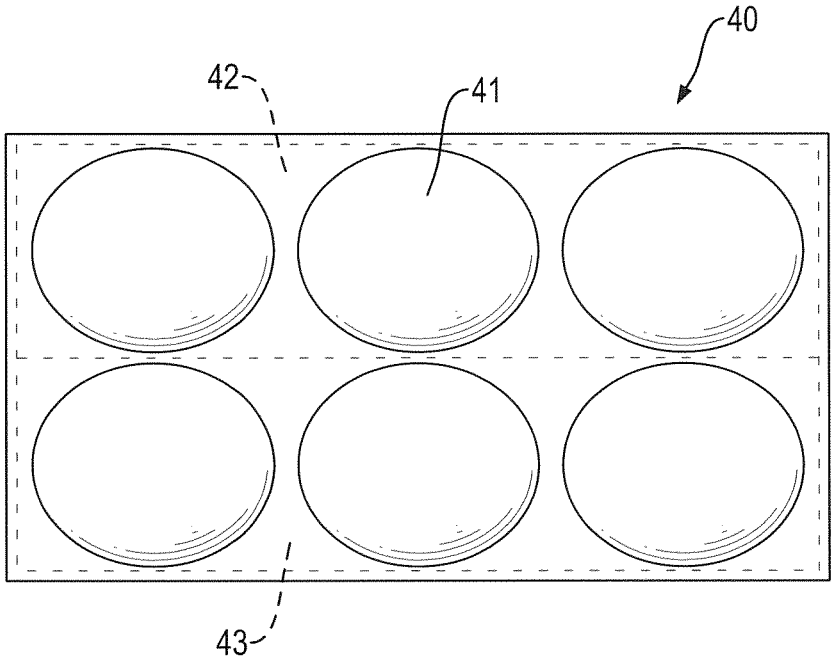
Figure 5A:
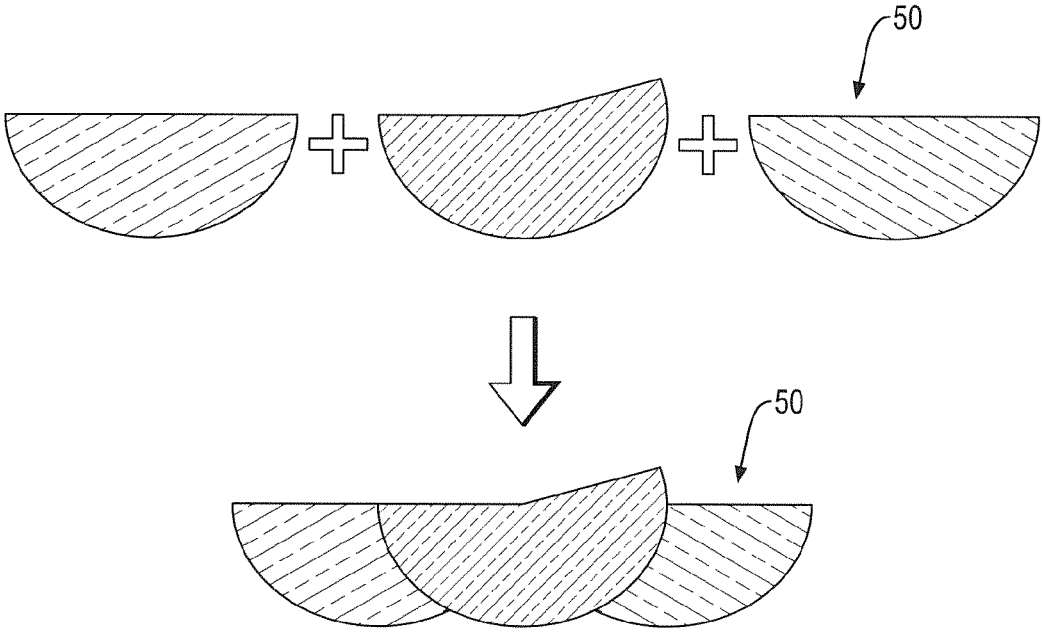
FIG. 5A and FIG. 5B are optical field views of the laser headlight system capable of varying optical fields in the present invention.
Figure 5B:
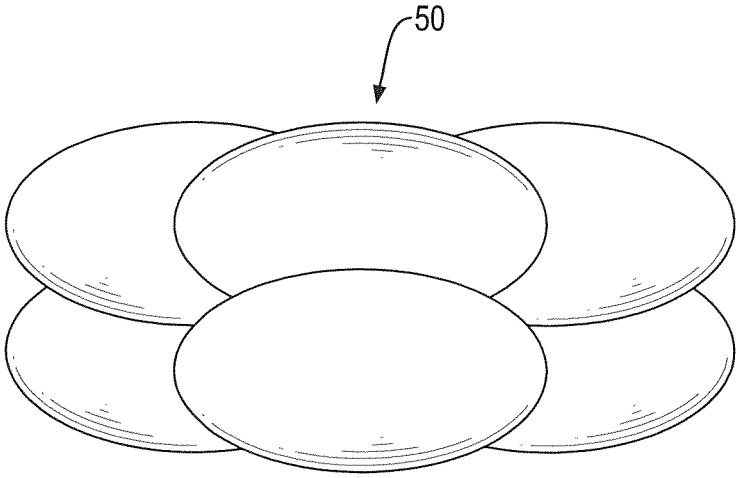

FIG. 4A and FIG. 4B are working views of the laser headlight system capable of varying optical fields in the present invention. With reference to 4A, FIG. 4B and FIG. 3A-FIG. 3D, in the present embodiment, the laser headlight system 40 includes six optical modules 41 and the six optical modules 41 can be separated into a top portion 42 and a bottom portion 43 having three of the optical modules 41 respectively. When the system 40 is operated in the low beam mode, as shown in FIG. 4A, the three optical modules 41 at the top portion 42 are turned off and the three optical modules 41 at the bottom portion 43 are turned on. Moreover, in the three optical modules 41 at the bottom portion 43, the optical modules 41 at two sides includes the mirror set 16 shown in FIG. 2A and the optical module 41 at the middle includes the mirror set 16 shown in FIG. 2B. The first reflective lens 161 in the mirror set 16 is moved behind the second reflective lens 162 and only the second reflective lens 162 of the three optical modules 41 at the bottom portion 43 can reflect the laser lights. Accordingly, the second reflective lens 162 of the three optical modules 41 at the bottom portion 43 of the laser headlight system 40 can illuminate and the optical field 50 is shown in FIG. 5A. When the laser headlight system 40 is operated in the high beam mode as shown in FIG. 4B, the six optical modules 41 are all turned on and the optical field 50 is shown in FIG. 5B. In accordance with the aforementioned laser headlight optical module structure, in the high beam mode, a maximum illumination value in a simulation result is 63.98 lux and an average illumination value at a horizontal area (±1125 mm) is 43.17 lux, in compliance with the international vehicle headlight law regulations. The width of the optical field is 8560 mm in compliance with the law regulations with the standard width 7920 mm.

Accordingly, the laser headlight optical module in the present invention can combine two reflective lenses together to form a mirror set in the oval shape when the headlight is operated in the high beam mode. When the headlight is operated in the low beam mode, the reflective lens at the top portion is moved behind the reflective lens at the bottom portion by the driving member and only the reflective lens at the bottom can reflect the light so as to generate the optical field for the low beams. No additional laser light sources or shutters are required in the laser headlight optical module of the present invention. The design with two reflective lenses can achieve results with high beams and low beams. In the vehicle headlight system, by the optical design, six optical modules are used and the vehicle headlight system can operate in the high beam mode and the low beam mode alternatively to meet the illumination standard of the high beams and the low beams stipulated in the law regulations.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A laser headlight optical module, comprising:

a laser light source configured to generate a laser light;

a convex lens located at a transmitting path of the laser light generated from the laser light source and configured to focus the laser light;

a substrate having a surface;

a phosphor layer including yellow fluorescent powders, disposed on the surface of the substrate, and located at the transmitting path of the laser light focused by the convex lens;

a mirror set located at the transmitting path of the laser light reflected from the phosphor layer;

a plurality of supporting rods located behind the mirror set and configured to support the mirror set; and a driving member located behind the mirror set and connected with the supporting rods, and the driving member configured to drive the supporting rods to vary a light reflective surface of the mirror set to change an optical field of the laser headlight optical module;

wherein the mirror set includes a first reflective lens and a second reflective lens.

2. The laser headlight optical module as claimed in claim 1, wherein the first reflective lens includes a first joint surface and the second reflective lens includes a second joint surface, and when the laser headlight optical module is operated in a high beam mode, the first joint surface of the first reflective lens and the second joint surface of the second reflective lens are coupled together to form an oval shape.

3. The laser headlight optical module as claimed in claim 1, wherein when the laser headlight optical module is operated in a low beam mode, the driving member drives the supporting rods to move the first reflective lens upward along a longitudinal axis to separate the first reflective lens from the second reflective lens, then drives the supporting rods to move the first reflective lens backward along a horizontal axis and move the first reflective lens downward along the longitudinal axis to move the first reflective lens behind the second reflective lens.

4. The laser headlight optical module as claimed in claim 1, wherein the first reflective lens and the second reflective lens are reflective lens in a semi-elliptical shape.

5. The laser headlight optical module as claimed in claim 1, wherein the first joint surface is complementary to the second joint surface.

6. A laser headlight system comprising six optical modules, three of the six optical modules located at a top portion of the laser headlight system and remaining three of the six optical modules located at a bottom portion of the laser headlight system, and at least one of the optical modules comprising:

a laser light source configured to generate a laser light;

a convex lens located at a transmitting path of the laser light generated from the laser light source and configured to focus the laser light;

a substrate having a phosphor layer disposed thereon, and the phosphor layer located at the transmitting path of the laser light focused by the convex lens and including yellow fluorescent powders;

a mirror set located at the transmitting path of the laser light reflected from the substrate with the phosphor layer;

a plurality of supporting rods located behind the mirror set and configured to support the mirror set;

a driving member located behind the mirror set and connected with the supporting rods, and the driving member configured to drive the supporting rods to vary a light reflective surface of the mirror set and change an optical field of the laser headlight system;

wherein the mirror set includes a first reflective lens and a second reflective lens, and when the optical modules of the laser headlight system are operated in a high beam mode, the optical modules are turned on and the first reflective lens and the second reflective lens are coupled together to form the mirror set in an oval shape.

7. The laser headlight system as claimed in claim 6, wherein when the laser headlight system is operated in a low beam mode and the optical modules at the top portion are turned off and the optical modules at the bottom portion are turned on, the driving member drives the supporting rods to move the first reflective lens upward along a longitudinal axis and the first reflective lens is separated from the second reflective lens, then the supporting rods move the first reflective lens backward along a horizontal axis and move the first reflective lens downward along the longitudinal axis to let the first reflective lens move behind the second reflective lens.

8. The laser headlight system as claimed in claim 6, wherein the first reflective lens and the second reflective lens are reflective lenses in a semi-elliptical shape.

9. The laser headlight system as claimed in claim 6, wherein the first reflective lens and the second reflective lens include a first joint surface and a second joint surface respectively, and the first joint surface of the first reflective lens is complementary to the second joint surface of the second reflective lens.

* * * * *